US006035444A

United States Patent [19]

McGrew

[11] Patent Number: 6,035,444

[45] Date of Patent: Mar. 14, 2000

[54] FREIGHT HANDLER'S GLOVE

[76] Inventor: Mitchell Keith McGrew, 8118 House St., Detroit, Mich. 48234

[21] Appl. No.: 09/130,592

[22] Filed: Aug. 7, 1998

[51] Int. Cl.[7] ..... A41D 19/00

[52] U.S. Cl. ..... 2/161.6; 2/16; 2/161.8

[58] Field of Search ..... 2/16, 20, 21, 158, 2/159, 160, 161.1, 161.2, 161.3, 161.4, 161.5, 161.6, 161.8, 163, 167, 907, 917

[56] References Cited

U.S. PATENT DOCUMENTS

| | | | |
|---|---|---|---|
| D. 380,285 | 7/1997 | Babcock . | |
| 1,149,139 | 8/1915 | Heagle | 2/159 |
| 1,479,771 | 1/1924 | Campbell . | |
| 1,483,595 | 2/1924 | Read . | |
| 2,700,159 | 1/1955 | Van Denburgh . | |
| 2,975,429 | 3/1961 | Newman . | |
| 4,094,014 | 6/1978 | Schroeder | 2/16 |
| 4,247,097 | 1/1981 | Schwartz . | |
| 4,575,075 | 3/1986 | Tarbox et al. . | |
| 4,684,123 | 8/1987 | Fabry . | |
| 4,766,612 | 8/1988 | Patton, Sr. . | |
| 4,813,079 | 3/1989 | Reitzel . | |
| 4,911,433 | 3/1990 | Walker et al. . | |
| 5,125,117 | 6/1992 | Buenos et al. . | |
| 5,146,628 | 9/1992 | Herrmann et al. | 2/16 |
| 5,300,000 | 4/1994 | Schwartz . | |
| 5,423,089 | 6/1995 | Chun et al. . | |
| 5,468,200 | 11/1995 | Hoffman . | |
| 5,500,956 | 3/1996 | Schulkin et al. | 2/159 |
| 5,575,008 | 11/1996 | McBride et al. . | |
| 5,598,582 | 2/1997 | Andrews et al. | 2/16 |
| 5,661,853 | 9/1997 | Wilmot | 2/163 |
| 5,873,788 | 2/1999 | Hoffman | 2/161.2 |

OTHER PUBLICATIONS

Plastic Dot Glove Product of MidWest Quality Gloves, Inc. Chillicothe, MD 64601 Date: unknown, but simular products on market for many years.

*Primary Examiner*—John J. Calvert
*Assistant Examiner*—Gary L. Welch
*Attorney, Agent, or Firm*—Peter D. Keefe

[57] ABSTRACT

A glove which addresses the grip ability and injury protection of freight handlers in the course of they daily work needs of lifting and moving articles, composed of a glove body having the following features: a plurality of generally distributed ventilation holes; soft elastomeric grip strips at the palm; and a tough, flexible and semi-rigid contact beading at the palm. The ventilation holes ensure that a hard working person's hand does not overly perspire within the glove body. The grip strips, preferably a neoprene, provide excellent grippage with articles. And, the contact beading, preferably an epoxy, provides excellent cut and abrasion protection, wherein a "crisscross" pattern thereof is preferred. At the palm side of the receptacle tips, a grip pad, preferably a neoprene, is provided. The base of the receptacle tips may be slit, whereby each receptacle tip is bendable back over the respective finger tips and thumb tip of the wearer to thereby selectively expose the respective finger tips and thumb tip. In this regard, a releasable fastener, such as for example a flexible hook and loop fastener, holds the receptacle tip in the bent over state. Optionally, the finger/thumb receptacles may be truncated.

14 Claims, 3 Drawing Sheets

FREIGHT HANDLER'S GLOVE

BACKGROUND OF THE INVENTION

1. Field of the Invention

The present invention relates to gloves, and more particularly to gloves worn by freight handlers in the course of their job duties. Still more particularly, the present invention relates to a glove for freight handlers which is structured to provide a good grip and excellent hand protection.

2. Description of the Prior Art

Gloves are well known in the art for protecting a person's hands from adverse environmental conditions and from injury in the course of labor activity. Freight handlers who must lift and carry a variety of articles resort to conventional gloves to assist them to grip these articles, while at the same time protecting their hands from injury.

Unfortunately, conventional gloves are not structured to simultaneously provide the grip enhancement and injury protection features needed by workers in the freight handling industry, such as package delivery workers, port workers, airline baggage handlers, and plant personnel. For example, conventional leather gloves may be too hot in the summer and may be too slippery to assuredly grasp an article if they are exposed to wet or oily conditions. Conventional cloth gloves may not provide adequate protection against injury.

Therefore, what remains needed is a glove which addresses the needs of freight handlers.

SUMMARY OF THE INVENTION

The present invention is a glove which addresses the grip ability and injury protection of freight handlers in the course of they daily work needs of lifting and moving articles.

The glove according to the present invention is composed of a glove body having the following features: a plurality of generally distributed ventilation holes; soft elastomeric grip strips at the palm; and a tough, flexible and semi-rigid contact beading at the palm. The ventilation holes ensure that a hard working person's hand does not overly perspire within the glove body. The grip strips, preferably a neoprene, provide excellent grippage with articles. And, the contact beading, preferably an epoxy, provides excellent cut and abrasion protection, wherein a "crisscross" pattern thereof is preferred.

Optionally, the finger/thumb receptacles may be truncated. Where finger/thumb receptacles are present, however, the contact beading continues therealong. At the palm side of the receptacle tips, a grip pad, preferably a neoprene, is provided.

As a further option where finger/thumb receptacles are provided, the base of the receptacle tips may be slit, whereby each receptacle tip is bendable back over the respective finger tips and thumb tip of the wearer to thereby selectively expose the respective finger tips and thumb tip. In this regard, a releasable fastener, such as for example a flexible hook and loop fastener, holds the receptacle tip in the bent over state.

Accordingly, it is an object of the present invention to provide a glove for freight handlers, wherein the glove is provided with grip enhancing material and abrasion resistant material.

It is a further object of the present invention to provide a glove which is grippingly and protectively suitable for repetitious handling of heavy and irregular articles.

These, and additional objects, advantages, features and benefits of the present invention will become apparent from the following specification.

DETAILED DESCRIPTION OF THE PREFERRED EMBODIMENT

Figure 2:
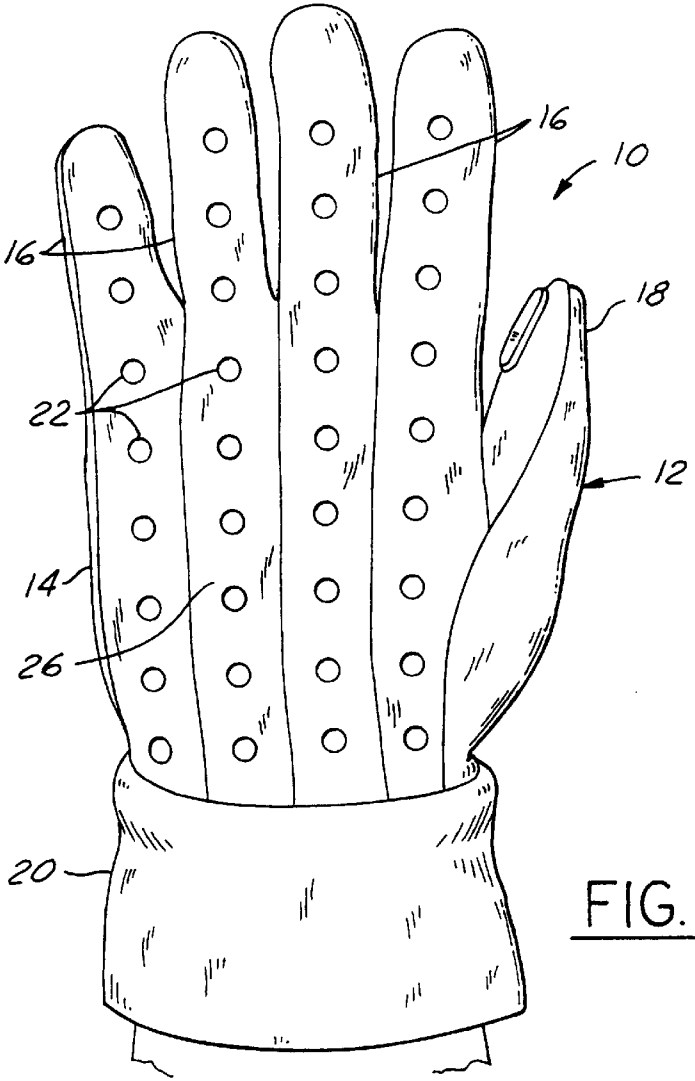
FIG. 2 is a back side view of the glove of FIG. 1.
Figure 1:
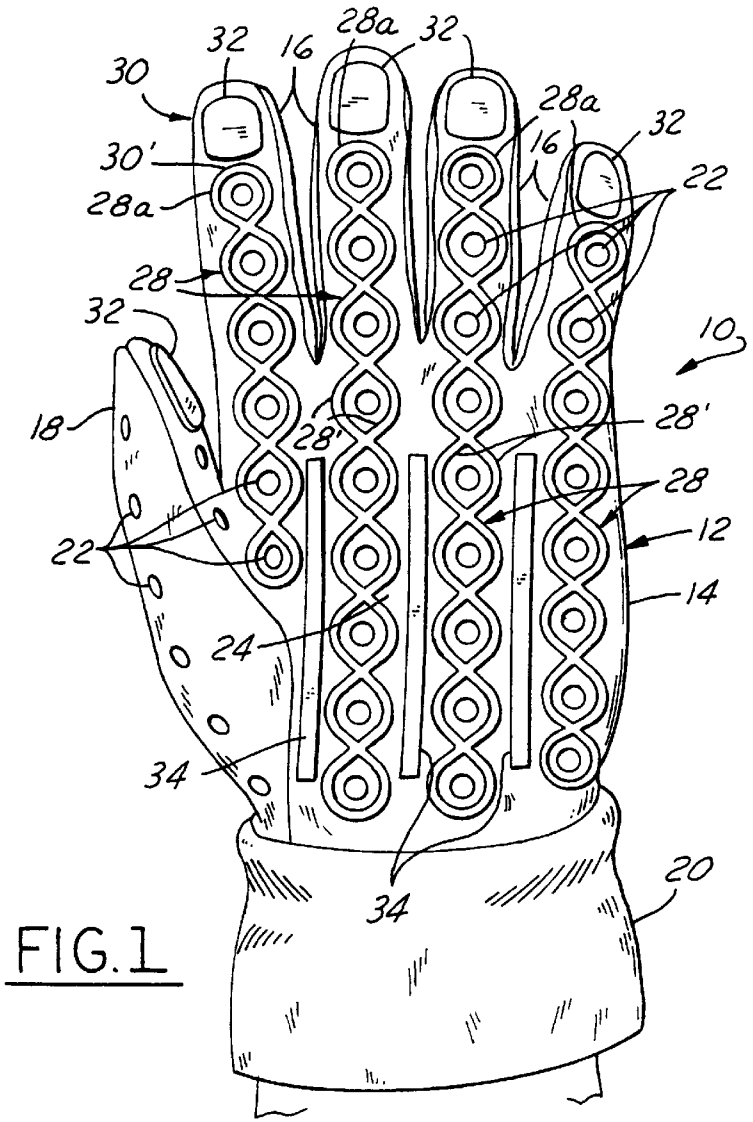
FIG. 1 is a palm side view of the glove according to the present invention.
Figures 5A, 5B, 5C, 5D:
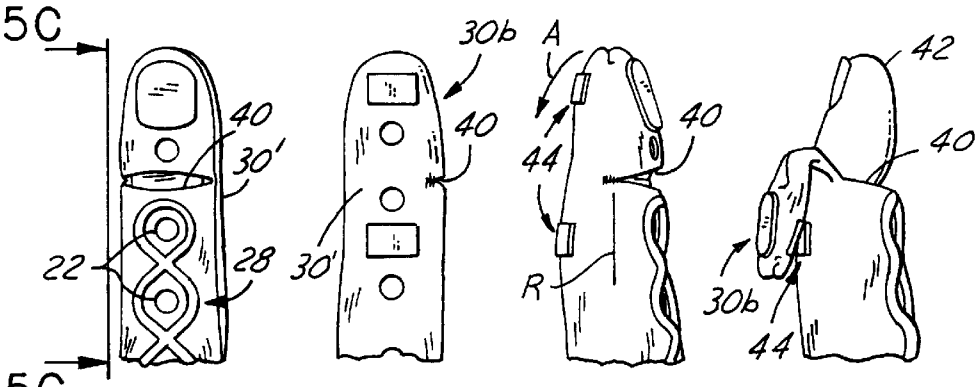
FIGS. 5A through 5D depict sequential views of a receptacle tip of the glove according to the present invention being bent over to expose a wearer's finger tip.

Referring now to FIGS. 1 and 2, a glove 10 according to the present invention includes a glove body 12 which is generally configured to conform to a wearer's left or right hand, and it is to be understood that a pair of gloves 10 is intended to be worn by both hands of the wearer. The glove body 12 includes a middle section 14, finger receptacles 16 and a thumb receptacle 18. Preferably, a cuff 20 is connected with the middle section 14, such as for example by sewing, for engaging the wrist of a wearer. The preferred material of the glove body 12 is a fabric, and while cotton is a preferred material, a most preferred material, however, is a tough, durable, abrasion resistant fabric, such as a heavy-duty canvass. Alternatively, the glove body 12 may be constructed of another material, such as a man-made material, leather or combinations of materials.

The glove body 12 is preferably provided with a plurality of ventilation holes 22 periodically distributed at the palm side 24 and the back side 26 thereof. It is preferred for the ventilation holes 22 to be placed not only at the middle section 14 of the glove body 12, but also at the finger receptacles 16 and the thumb receptacle 18. The ventilation holes 22 are sufficiently large and of sufficiently multiplicity (such as for non-limiting example at least about 50 holes) so as to provide interaction between the environment and the wearer's hand so that heat and/or perspiration does not untowardly build-up within the glove body 12 in the course of work, yet the ventilation holes are not so large or numerous so as to compromise the hand protective features of the glove body.

The palm side 24 of the glove body 12 is preferably provided with a contact beading 28. The preferred contact beading 28 is an abrasion and cut resistant semi-rigid material which is flexible, such as for example an epoxy material. An acceptable contact beading 28 is the glue material used for glue sticks of hot glue guns, wherein the glue stick is melted and then applied as a beading to the glove body 12; upon drying, the glue material is not only well adhered to the glove body, but is semi-rigid and flexible. It is preferred for the contact beading 28 to be placed in a plurality of elongate rows 28*a*, each row having beading 28' characterized by a crisscross pattern that crisscrosses ventilation holes 22 in the path of the row. By way of example, the beads 28' may be about one-quarter of an inch wide and about one-eighth of an inch high in relation to the glove body 12. Each row 28*a* is linearly associated with each of the finger receptacles 16, extending from the middle section 14 and along each respective finger receptacle up to the base 30' of the receptacle tip 30 thereof.

At the palm side 24 of the receptacle tips 30 of the finger receptacles 16 it is preferred for a grip pad 32 to be affixed thereto, such as for example by an adhesive. Each grip pad 32 is composed of a preferably highly frictional material, such as for example neoprene. It is further preferred for grip strips 34 to be provided on the palm side 24 of the middle section 14 between the rows 28*a*, such as for example by an adhesive. The grip strips 34 are also composed of a preferably highly frictional material, most preferably the same material as used for the grip pads 32. Preferably, the height of the grip strip 34 exceeds that of the contact beading 28 so that the presence of the contact beading does not adversely affect the enhanced grippage afforded by the grip strips. In this regard, it is to be understood that the grip strips 34 and the grip pads 32 afford a higher coefficient of friction with grasped articles than afforded by the glove body itself.

In operation of the glove 10, the user places a glove body 12 onto one hand or respectively onto each hand. The user then goes to work grabbing articles, lifting and/or moving them as the case may be. In so doing, the grip pads and grip strips aid the user to grasp the article without fumbling or otherwise loosing the grasp even under adverse environmental conditions, such as rain or snow. Further in so doing, the rows 28*a* of abrasion resistant material 28 serve to protect the user from possible injury due to sharp or pointed aspects of the articles.

Turning now to FIGS. 3 through 7, variations of the glove according to the present invention will be discussed.

Figure 3:
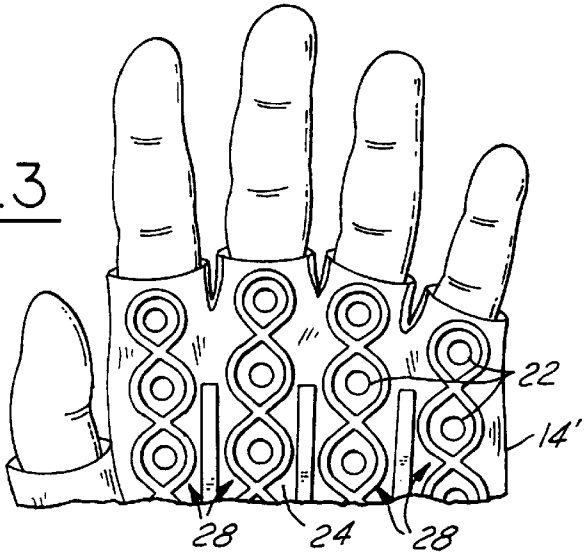
FIG. 3 is a partly cut-away palm side view of the glove according to the present invention, wherein the finger and thumb receptacles are truncated.
Figure 4:
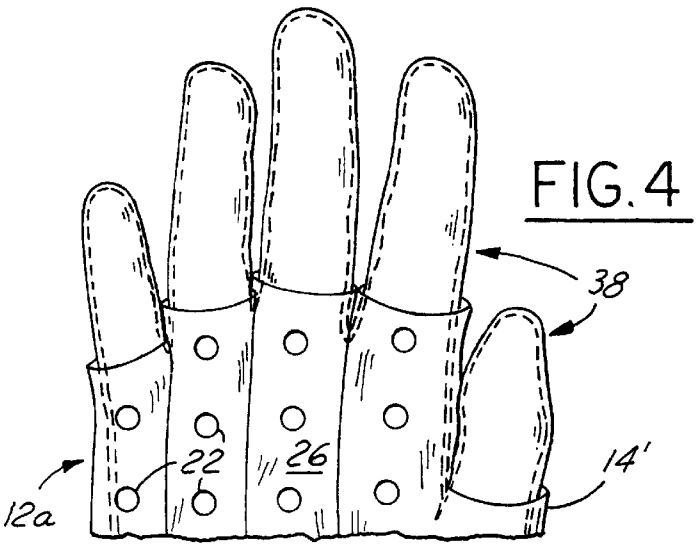
FIG. 4 is a partly cut-away back side view of the glove of FIG. 3, wherein a liner is worn by the user.

FIG. 3 depicts a version of the glove wherein the finger and thumb receptacles are truncated, while the middle section 14' remains as described hereinabove. FIG. 4 depicts the glove of FIG. 3, wherein an insert 38 is worn beneath the glove body 12*a*, the insert being suited for providing insulation during cold work conditions.

FIGS. 5A through 5D depict a variation of the glove wherein the base 30' of the receptacle tips 30*b* of the finger and thumb receptacles are each provided with a slit 40 across the palm side in perpendicular relation to the receptacle axis R. The slits 40 allow the receptacle tips 30*b* to function as described hereinabove (see FIGS. 5A and 5B), yet allow the receptacle tips to be selectively bent over the user's finger tips 42 along arrow A to thereby expose the finger tips (see FIGS. 5C and 5D). In order to hold the receptacle tips 30*b* in the bent-over configuration depicted by FIG. 5D, a selectively releasable fastener 44 is preferred to be provided, which is located at the back side of the finger and thumb receptacles. A preferred fastener 44 is a flexible hook and loop fastener, such as VELCRO (a trademarked product of Velcro USA).

In operation, a user grasps a selected receptacle tip and causes it to bend at the base 30' opposite the slit 40 so as rotate toward the back side of the glove body, whereduring the finger/thumb tip of the user protrudes through the slit. Upon a rotation of about 180 degrees of the receptacle tip, the fastener 44 engages and holds the receptacle tip in the bent-over configuration. Having the receptacle tips 30*b* bendable into the bent-over configuration allows the user to use his or her bare finger/thumb tips to clasp or touch tactile sensitive items, such as for example push buttons, computer keys or grasping papers, without need of removal of the glove body.

Figure 6A:
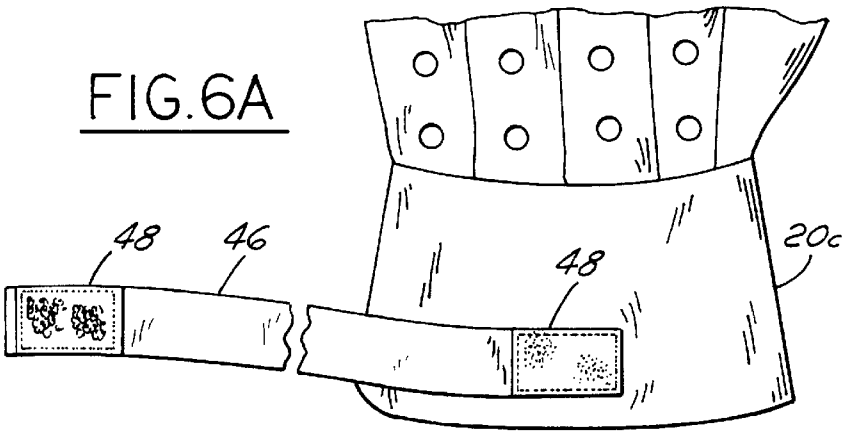
FIGS. 6A and 6B depict sequential views of a securing band of the glove according to the present invention wrappingly engirding the wrist of a wearer.
Figure 6B:
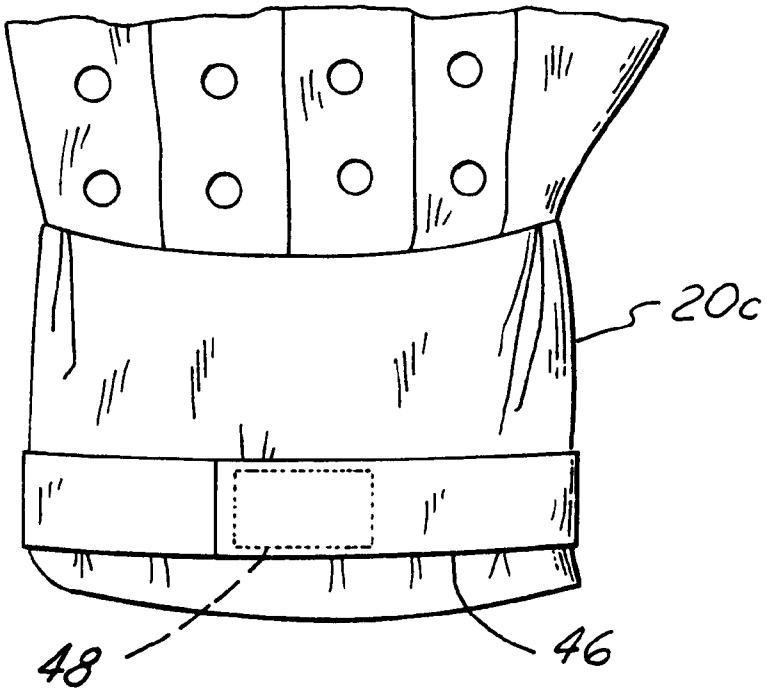

FIGS. 6A and 6B depict a variation of the glove, wherein a cuff 20*c* is equipped with a securing band 46. The securing band 46 is used to tightly wrap around the wearer's wrist to securely hold the glove onto the hand. A fastener 48 is used to hold the securing band in its tightly wrapped state, wherein the preferred fastener is VELCRO.

Figure 7:
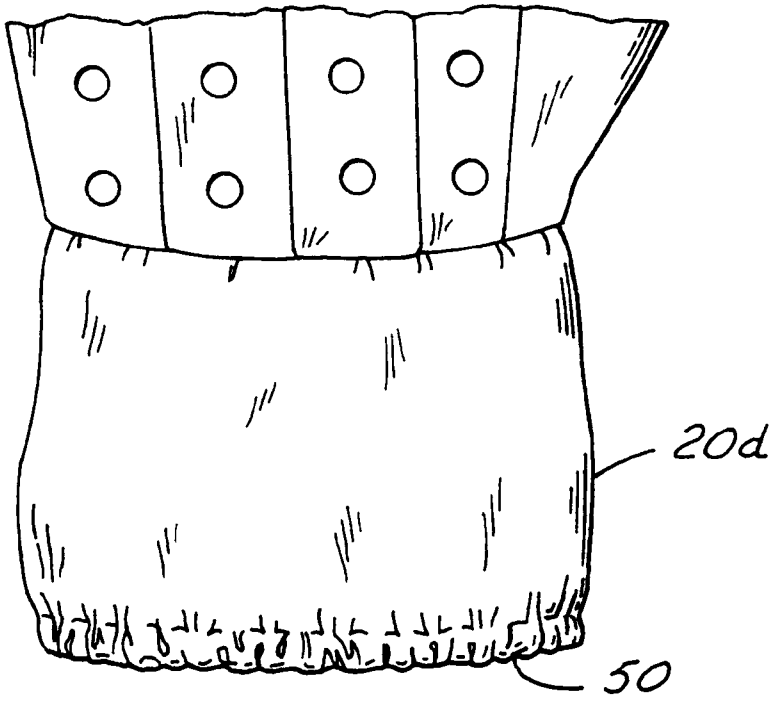
FIG. 7 depicts a wrist extension of the glove according to the present invention having an elastic gather at its end.

Finally, FIG. 7 discloses a variation of the glove, wherein an extended cuff 20*d* has an elastic gather 50 at its end for use in harsh, wintry conditions.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A glove suited for use by freight handlers to grasp articles, said glove comprising:

a glove body comprising a middle section, four finger receptacles connected with said middle section, a thumb receptacle connected with said middle section, a palm side and an opposite back side;

contact beading connected with said middle section at said palm side thereof for providing a cut and abrasion resistant contact with grasped articles, said contact beading being distributed over substantially all of said middle section as a plurality of mutually separated rows, wherein each row is aligned with a respective finger receptacle so as to form a spacing between adjacent rows at said middle section; and a plurality of grip strips connected with said middle section at said palm side, a grip strip being respectively located at each spacing between adjacent rows, wherein the grip strips provide a coefficient of friction with respect to grasped articles that exceeds that of said glove body.

2. The glove of claim 1, wherein each said row comprises said contact beading having a crisscross pattern.

3. The glove of claim 1, wherein said four finger receptacles and said thumb receptacle each terminate in a respective receptacle tip; said glove further comprising grip pad means connected with said receptacle tip of said finger and thumb receptacles at said palm side of said glove body for providing a coefficient of friction with respect to grasped articles that exceeds that of said glove body.

4. The glove of claim 3, wherein each said row comprises said contact beading having a crisscross pattern.

5. The glove of claim 4, wherein said glove body is provided with a multiplicity of ventilation holes, wherein said crisscross pattern crisscrosses a plurality of said ventilation holes.

6. The glove of claim 3, wherein said finger and thumb receptacles have a receptacle axis, and wherein said receptacle tips have a base, a slit being formed in said receptacle tip at said base thereof, said slit being substantially perpendicular to said receptacle axis and located at said palm side of said glove body;

wherein each said receptacle tip is selectively bendable at said base opposite said slot such that said receptacle tip is rotatable into a bent-over configuration by being rotated substantially 180 degrees toward said back side of said glove body; and further comprising releasable fastener means at said back side of said glove body for selectively holding each respective receptacle tip in the bent-over configuration thereof.

7. The glove of claim 1, further comprising a cuff connected with said middle section, said cuff having an elastic gather.

8. A glove suited for use by freight handlers to grasp articles, said glove comprising:

a glove body comprising a middle section, a palm side and an opposite back side, said glove body further comprising four finger receptacles and a thumb receptacle connected with said middle section, each of said finger and thumb receptacles terminating in a respective receptacle tip, and wherein said finger and thumb receptacles have a receptacle axis; wherein said receptacle tips have a base, a slit being formed in said receptacle tip at said base thereof, said slit being substantially perpendicular to said receptacle axis and located at said palm side of said glove body;

wherein each said receptacle tip is selectively bendable at said base opposite said slot such that said receptacle tip is rotatable into a bent-over configuration by being rotated substantially 180 degrees toward said back side of said glove body.

9. The glove of claim 8, further comprising releasable fastener means at said back side of said glove body for selectively holding each respective receptacle tip in the bent-over configuration thereof.

10. The glove of claim 9, further comprising contact beading means connected with said middle section at said palm side thereof for providing a cut and abrasion resistant contact with grasped articles.

11. The glove of claim 9, further comprising grip strip means connected with said middle section at said palm side of said glove body for providing a coefficient of friction with respect to grasped articles that exceeds that of said glove body.

12. The glove of claim 9, further comprising grip pad means connected with said receptacle tip of said finger and thumb receptacles at said palm side of said glove body for providing a coefficient of friction with respect to grasped articles that exceeds that of said glove body.

13. The glove of claim 9, wherein said glove body is provided with a multiplicity of ventilation holes.

14. A glove suited for use by freight handlers to grasp articles, said glove comprising:

a glove body comprising a middle section, four finger receptacles connected with said middle section, a thumb receptacle connected with said middle section, a palm side and an opposite back side;

contact beading connected with said middle section at said palm side thereof for providing a cut and abrasion resistant contact with grasped articles, said contact beading being distributed over substantially all of said middle section as a plurality of mutually separated rows, wherein each row is aligned with a respective finger receptacle so as to form a spacing between adjacent rows at said middle section; and a plurality of grip strips connected with said middle section at said palm side, a grip strip being respectively located at each spacing between adjacent rows, wherein the grip strips provide a coefficient of friction with respect to grasped articles that exceeds that of said glove body;

wherein said finger and thumb receptacles have a receptacle axis, and wherein said receptacle tips have a base, a slit being formed in said receptacle tip at said base thereof, said slit being substantially perpendicular to said receptacle axis and located at said palm side of said glove body;

wherein each said receptacle tip is selectively bendable at said base opposite said slot such that said receptacle tip is rotatable into a bent-over configuration by being rotated substantially 180 degrees toward said back side of said glove body; and further comprising releasable fastener means at said back side of said glove body for selectively holding each respective receptacle tip in the bent-over configuration thereof.

* * * * *